US011141782B2

(12) United States Patent
He et al.

(10) Patent No.: US 11,141,782 B2
(45) Date of Patent: Oct. 12, 2021

(54) HEAT TRANSFER-BASED WIDTH ADJUSTMENT METHOD FOR CONTINUOUS CASTING MOLD

(71) Applicant: CISDI RESEARCH AND DEVELOPMENT CO., LTD., Chongqing (CN)

(72) Inventors: Xinjun He, Chongqing (CN); Zhiwei Han, Chongqing (CN); Xiaohua Peng, Chongqing (CN); Jiang Chen, Chongqing (CN)

(73) Assignee: CISDI Research And Development Co., Ltd., Chongqing (CN)

( * ) Notice: Subject to any disclaimer, the term of this patent is extended or adjusted under 35 U.S.C. 154(b) by 0 days.

(21) Appl. No.: 16/602,300

(22) PCT Filed: Sep. 21, 2017

(86) PCT No.: PCT/CN2017/102736

§ 371 (c)(1),
(2) Date: Sep. 9, 2019

(87) PCT Pub. No.: WO2018/161529

PCT Pub. Date: Sep. 13, 2018

(65) Prior Publication Data

US 2020/0290115 A1 Sep. 17, 2020

(30) Foreign Application Priority Data

Mar. 8, 2017 (CN) ..... 201710135751.8

(51) Int. Cl.
*B22D 11/16* (2006.01)

(52) U.S. Cl.
CPC ..... *B22D 11/168* (2013.01)

(58) Field of Classification Search
CPC ..... B22D 11/168
See application file for complete search history.

(56) References Cited

U.S. PATENT DOCUMENTS 4,134,441 A * 1/1979 Ohmori ..... B22D 11/168 164/418
4,413,667 A * 11/1983 Schrewe ..... B22D 11/168 164/450.5

(Continued)

*Primary Examiner* — Kevin E Yoon
(74) *Attorney, Agent, or Firm* — Michael D. Eisenberg

(57) ABSTRACT

The present invention provides a heat transfer-based width adjustment method for a continuous casting mold. A boundary condition of a horizontal acceleration velocity α used in heat transfer-based width adjustment of a continuous casting mold is set to a minimum value subject to constraints of a maximum air gap and shell strength. The present invention can constrain a maximum air gap between a copper plate of a narrow mold wall and a casting billet in a heat transfer-based width adjustment process for a continuous casting mold, thereby ensuring sufficient contact between the copper plate of the narrow mold wall and the casting billet, so as to prevent cracks and other defects of the casting billet due to excessive thermal resistance of the air gap, insufficient corner cooling of the casting billet, delayed solidification and concentrated thermal deformation stress. Moreover, a strain of the shell is controlled to be less than a critical strain, thereby preventing collapse of the casting billet, and preventing the casting billet from being scrapped as a result of an uneven narrow wall. Furthermore, since parameter settings of a width adjustment model dynamically change with a casting speed change, width adjustment can be performed within a full casting speed range without having to increase or decrease the casting speed.

9 Claims, 2 Drawing Sheets

(56) References Cited

U.S. PATENT DOCUMENTS 4,660,617 A * 4/1987 Tsutsumi ..... B22D 11/168
164/451
5,205,345 A * 4/1993 McClellan ..... B22D 11/16
164/154.5

* cited by examiner

HEAT TRANSFER-BASED WIDTH ADJUSTMENT METHOD FOR CONTINUOUS CASTING MOLD

TECHNICAL FIELD

The present invention relates to the field of metallurgical continuous casting, and in particular to a heat transfer-based width adjustment method for a continuous casting mold.

BACKGROUND

Iron and steel metallurgical industry is one of the strategic industries of a country, which is closely related to the national economy. As a key link between the preceding and the following in an iron or steel production process, continuous casting is a core link worthy of special attention in the iron and steel production structure adjustment and technology upgrading strategy of China. In recent years, continuous casting technology has developed to a very high technical level to expand the production range and improve the product quality. Especially with the rise of continuous casting and rolling technology, a continuous casting machine must match the production rhythm of hot rolling quickly and provide billets that meet the specification and size requirements of hot rolling. Moreover, how to adapt to the requirements of small-batch and multi-specification products is also an important topic for iron and steel enterprises. A heat transfer-based width adjustment technology tor a continuous casting mold comes into being, which avoids the loss of raw materials and time caused by the replacement of continuous casting mold and the second start of casting, improves the utilization rate of equipment and the metallic yield, reduces the production consumption and production cost, and is a core technology of continuous casting with high attention in the industry.

At present, the heat transfer-based width adjustment technology is developed in the direction of high speed, such as the S-mode for heat transfer-based width adjustment of Voestalpine and the NS-VWM (rapid width adjusting continuous casting mold) technology of NSSC. The most important feature of high-speed heat transfer-based width adjustment technology is that the taper change and parallel moving of a narrow mold wall are carried out simultaneously, which greatly shortens the time of width adjustment and reduces the cutting waste caused by width adjustment. Model parameter setting is one of the key technologies used for heat transfer-based width adjustment of a continuous casting mold, and a horizontal acceleration velocity used in heat transfer-based width adjustment of a continuous casting mold and an angular velocity of taper change of a narrow mold wall are the most important parameters, the values of which play a decisive role in the safety and reliability of an on-line width adjustment system for a continuous casting mold. Once the model parameters are set unreasonably, excessive extrusion of a casting billet by the narrow mold wall in a heat transfer-based width adjustment process for a continuous casting mold will cause cracks and other defects of the casting billet, or cause an excessive air gap between the narrow mold wall and the casting billet, which will affect the solidification and uniformity of a shell, and even cause serious production accidents such as bulging steel leakage or bonding steel leakage when the excessive extrusion is serious enough.

NSSC (U.S. Pat. No. 4,660,617A) discloses a width adjustment method for a slab continuous casting mold, which uses shell strength as the basis for setting horizontal acceleration velocity and other parameters used in width adjustment, thereby realizing the preparation technology of high-speed width adjustment. Since only constraint of shell strength is considered and influence of an air gap of a casting billet in middle and low casting speed range is not considered, high-speed width adjustment must match with a relatively high casting speed in an actual production process, otherwise side wall "concave" defects or shell cracking steel leakage will be caused, which does not match with the casting of certain steel types with large section and low casting speed.

A reference of *Study on the Speed of On-Line Mould Width Adjustment* has studied the width adjustment speed based on a width adjustment principle that "strain rate of a shell is equal to shrinkage rate of the shell", and a reference of *Study on Casting Speed and the Speed of on-line Mould Width Adjustment of Slab Continuous Casting* has deduced a method for calculating width adjustment speed and quantitatively studied a reasonable casting speed changing process based on the stress state of a shell in a mold width adjustment process. Both of the two method studies are based on the stress state of a casting billet shell without considering the influence of an air gap in a width adjustment process. Moreover, the only model parameter studied therein is width adjustment speed, and key parameters such as horizontal acceleration velocity used in width adjustment and angular velocity of a narrow mold wall are not comprehensively considered, so the safety of continuous casting production in a heat transfer-based width adjustment process for a mold cannot be fully guaranteed.

SUMMARY

In view of the above defects in the prior art, the purpose of the present invention is to provide a heat transfer-based width adjustment method for a continuous casting mold to solve problems such as improper control of key parameters in heat transfer-based width adjustment of a continuous casting mold in the prior art.

To achieve the above purpose and other relevant purposes, the first aspect of the present invention provides a heat transfer-based width adjustment method for a continuous casting mold. A boundary condition of a horizontal acceleration velocity $\alpha$ used in heat transfer-based width adjustment of a continuous casting mold is set to a minimum value subject to constraints of a maximum air gap and shell strength, as shown in formula (1):

$$\alpha \leq \min(\alpha_\eta, \alpha_\varepsilon) \tag{1}$$

in formula (1), $\alpha_\eta$ is a maximum horizontal acceleration velocity subject to constraints of a maximum allowable air gap between a narrow mold wall and a casting billet shell of a continuous casting mold, and the unit is mm/min$^2$; $\alpha_\varepsilon$ is a maximum horizontal acceleration velocity subject to constraint of shell strength, and the unit is mm/min$^2$.

In some embodiments of the present invention, $0.8 \cdot \min(\alpha_\eta, \alpha_\varepsilon) \leq \alpha \leq \min(\alpha_\eta, \alpha_\varepsilon)$.

In some embodiments of the present invention, $\alpha$ shall be as high as possible in the condition of satisfying formula (1), i.e. $\alpha = \min(\alpha_\eta, \alpha_\varepsilon)$.

In some embodiments of the present invention, the maximum horizontal acceleration velocity subject to constraints of a maximum allowable air gap between a narrow mold wall and a casting billet shell of a continuous casting mold $\alpha_\eta$ is shown in formula (2):

$$\alpha_\eta \le \frac{4\eta_{max}U_c^2}{L^2} \quad (2)$$

in formula (2), $\eta_{max}$ is a maximum allowable air gap between a narrow mold wall and a casting billet shell of a continuous casting mold, and the unit is mm; $U_C$ is a casting speed, and the unit is mm/min; L is an effective height of a continuous casting mold, i.e. a distance from the level of molten steel to the bottom of the mold, and the unit is mm.

In some embodiments of the present invention, 1 mm $\leqslant \eta_{max} \leqslant$ 4 mm.

In some embodiments of the present invention, $\eta_{max}$=2 mm.

In some embodiments of the present invention, the maximum horizontal acceleration velocity subject to constraint of shell strength $\alpha_\varepsilon$ is shown in formula (3):

$$\alpha_\varepsilon \le \frac{2W\dot{\varepsilon}_o U_c}{L} \quad (3)$$

in formula (3), W is half of a width of a casting billet, and the unit is mm; $\dot{\varepsilon}_0$ is a critical strain rate of the casting billet, and the unit is $min^{-1}$; $U_C$ is a casting speed, and the unit is mm/min; L is an effective height of a continuous casting mold, and the unit is mm.

In some embodiments of the present invention, $1.2\times10^{-2}\cdot min^{-1} \leqslant \dot{\varepsilon}_0 \leqslant 3.3\times10^{-2}\cdot min^{-1}$.

In some embodiments of the present invention, $\dot{\varepsilon}_0=1.8\times10^{-2}\cdot min^{-1}$.

In some embodiments of the present invention, 450 mm $\leqslant W \leqslant$ 1300 mm.

In some embodiments of the present invention, 600 mm/min $\leqslant U_C \leqslant$ 2400 mm/min.

In some embodiments of the present invention, 800 mm $\leqslant L \leqslant$ 900 mm.

In some embodiments of the present invention, movement of a narrow mold wall of a continuous casting mold is a combination of horizontal movement and taper change movement, and angular velocity ω satisfies the following formula:

$$\omega=\alpha/U_C \quad (4)$$

in formula (4), the unit of the angular velocity ω is rad/min, and the unit of the casting speed $U_C$ is mm/min.

In some embodiments of the present invention, a horizontal moving speed $V_h$ used in heat transfer-based width adjustment of a continuous casting mold is in linear proportion to an acceleration velocity used therein, satisfying the following formula:

$$V_h=\alpha t \quad (5)$$

where, the unit of the horizontal moving speed $V_h$ is mm/min, and the unit of time t is min.

As described above, the heat transfer-based width adjustment method for a continuous casting mold of the present invention has the following beneficial effects: by using the above method, the present invention can constrain a maximum air gap between a copper plate of a narrow mold wall and a casting billet in a heat transfer-based width adjustment process for a continuous casting mold, thereby ensuring sufficient contact between the copper plate of the narrow mold wall and the casting billet, so as to prevent cracks and other defects of the casting billet due to excessive thermal resistance of the air gap, insufficient corner cooling of the casting billet, delayed solidification and concentrated thermal deformation stress. Moreover, a strain of the shell is controlled to be less than a critical strain, thereby preventing collapse of the casting billet, and preventing the casting billet from being scrapped as a result of an uneven narrow wall. Furthermore, since parameter settings of a width adjustment model dynamically change with a casting speed change, width adjustment can be performed within a full casting speed range without having to increase or decrease the casting speed.

DETAILED DESCRIPTION

Figure 1A:
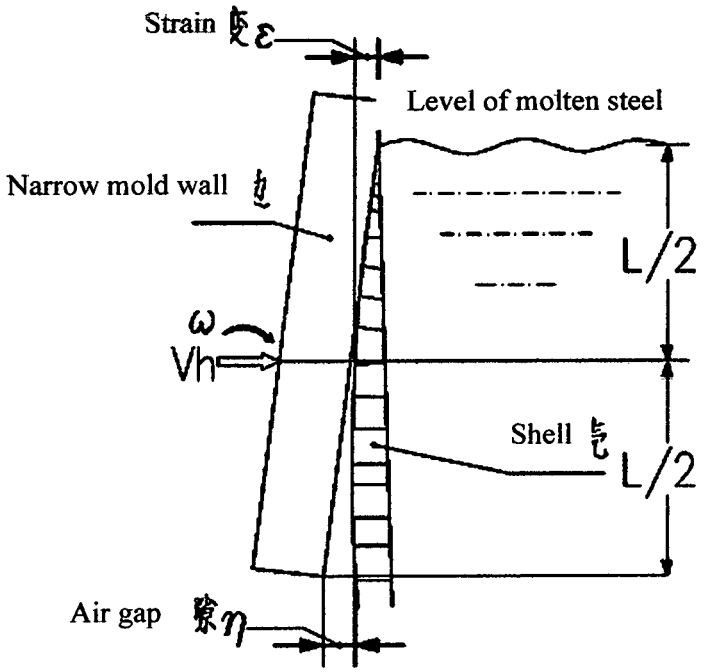
FIG. 1*a* is a schematic diagram of a deformation and air gap of a casting billet shell when a narrow mold wall rotates clockwise in a heat transfer-based width adjustment process for a continuous casting mold of an embodiment of the present invention.

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention.

To study model parameters used in heat transfer-based width adjustment of a continuous casting mold, the first consideration is to avoid surface quality defects (such as surface cracks, narrow mold wall bulging, and collapse) in a casting billet and ensure production safety (such as avoiding steel leakage accidents caused by heat transfer-based width adjustment), which can be solved from two aspects: constraint of a maximum air gap (sufficient and uniform cooling is ensured, thereby preventing narrow mold wall bulging) and constraint of shell strength (a strain of the shell is controlled to be less than a critical strain, thereby preventing collapse of the casting billet). Width adjustment speed is a linear function of acceleration velocity, and the angular velocity of the narrow mold wall directly reflects the contact state between the narrow mold wall and the casting billet, therefore the study of horizontal acceleration velocity and angular velocity of width adjustment is of more guiding significance to parameter settings of a heat transfer-based width adjustment model of a continuous casting mold in practical production.

The present invention provides a heat transfer-based width adjustment method for a continuous casting mold. A boundary condition of a horizontal acceleration velocity α used in heat transfer-based width adjustment of a continuous casting mold is set to a minimum value subject to constraints of shell strength and a maximum air gap, as shown in formula (1):

$$\alpha \le \min(\alpha_\eta, \alpha_\varepsilon) \quad (1)$$

where, $\alpha_\eta$ is a maximum horizontal acceleration velocity subject to constraints of a maximum allowable air gap between a narrow mold wall and a casting billet shell of a continuous casting mold, and the unit is mm/min$^2$; $\alpha_\varepsilon$ is a maximum horizontal acceleration velocity subject to constraint of shell strength, and the unit is mm/min$^2$.

The maximum horizontal acceleration velocity subject to constraints of a maximum allowable air gap between a narrow mold wall and a casting billet shell of a continuous casting mold $\alpha_\eta$ is shown in formula (2):

$$\alpha_\eta \leq \frac{4\eta_{max}U_c^2}{L^2} \tag{2}$$

where, $\eta_{max}$ is a maximum allowable air gap between a narrow mold wall and a casting billet shell of a continuous casting mold, and the unit is mm; $U_C$ is a casting speed, and the unit is mm/min; L is an effective height of a continuous casting mold, and the unit is mm.

The value range of the maximum allowable air gap between a narrow mold wall and a casting billet shell of a continuous casting mold $\eta_{max}$ is from 1 mm to 4 mm, and more preferably, the value of $\eta_{max}$ is 2 mm.

The maximum horizontal acceleration velocity subject to constraint of shell strength $\alpha_\varepsilon$ is shown in formula (3):

$$\alpha_\varepsilon \leq \frac{2W\dot{\varepsilon}_o U_c}{L} \tag{3}$$

where, W is half of a width of a casting billet, and the unit is mm; $U_C$ is a casting speed, and the unit is mm/min; $\dot{\varepsilon}_0$ is a critical strain rate of the casting billet, and the unit is min$^{-1}$; L is an effective height of a continuous casting mold, and the unit is mm.

The critical strain rate of the casting billet $\dot{\varepsilon}_0$ is related to steel grade and shell temperature, and the value range is $1.2\times10^{-2}\cdot mm^{-1} \leqslant \dot{\varepsilon}_0 \leqslant 3.3\times10^{-2}\cdot mm^{-1}$, and more preferably, the value of $\dot{\varepsilon}_0$ is $1.8\times10^{-2}\cdot min^{-1}$.

It should be noted that in middle and low casting speed range, the value of a horizontal acceleration velocity $\alpha$ mainly depends on the constraint of a maximum air gap, and the set value is in direct proportion to the square of the casting speed $U_C$; in high casting speed range, the value of a horizontal acceleration velocity $\alpha$ mainly depends on the constraint of shell strength, and the set value is in direct proportion to the casting speed $U_C$.

Further, movement of a narrow mold wall of a continuous casting mold is a combination of horizontal movement and taper change movement, and angular velocity $\omega$ satisfies the following formula:

$$\omega - \alpha/U_C \tag{4}$$

where, the unit of the angular velocity $\omega$ is rad/min, the unit of the casting speed $U_C$ is mm/min, and the unit of the horizontal acceleration velocity $\alpha$ is mm/min$^2$.

Further, a horizontal moving speed $V_h$ used in heat transfer-based width adjustment of a continuous casting mold is in linear proportion to an acceleration velocity $\alpha$ used therein, and the initial velocity is 0, satisfying the following formula:

$$V_h \alpha t \tag{5}$$

where, the unit of the horizontal moving speed $V_h$ is mm/min, and the unit of time t is min.

The present invention is described in detail below in combination with FIG. 1*a*, FIG. 1*b* and FIG. 2.

Figure 1B:
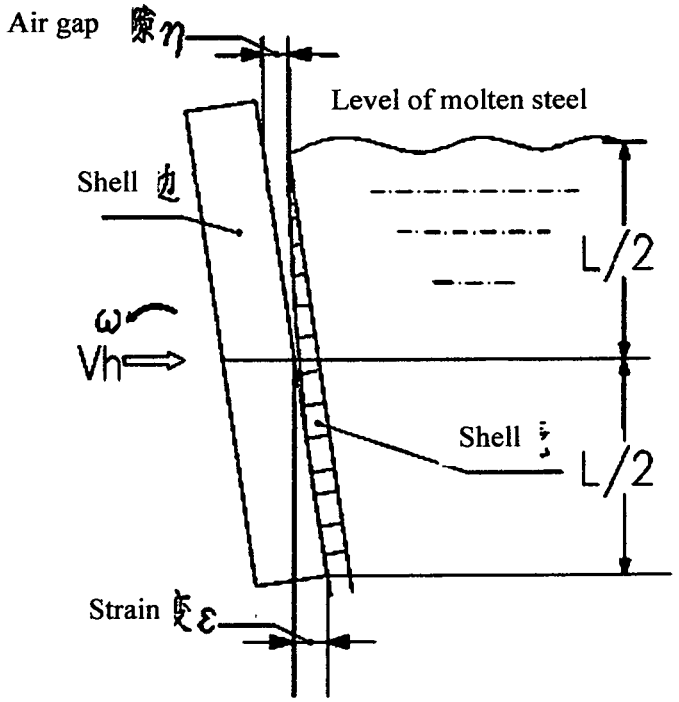
FIG. 1*b* is a schematic diagram of a deformation and air gap of a casting billet shell when a narrow mold wall rotates counter-clockwise in a heat transfer-based width adjustment process for a continuous casting mold of an embodiment of the present invention.

FIG. 1*a* and FIG. 1*b* are schematic diagrams of a deformation and air gap of a casting billet shell when a narrow mold wall rotates in a heat transfer-based width adjustment process for a continuous casting mold. Heat transfer-based width adjustment of a continuous casting mold is divided into at least two steps, i.e. taper change and taper recovery: as shown in FIG. 1*a*, when the taper is changed from small to large (taper change), the direction of the angular velocity $\omega$ is clockwise, the shell deformation rate at the upper end of the narrow mold wall is positive, the casting billet is compressed, the shell deformation rate of the lower end of the narrow mold wall is negative, and an air gap is formed between the shell and the lower end of the narrow mold wall of a continuous casting mold; as shown in FIG. 1*b*, when the taper is changed from large to small (taper recovery), the direction of the angular velocity $\omega$ is counter-clockwise, an air gap is formed between the shell and the upper end of the narrow mold wall, and the shell at the lower end of the narrow mold wall is compressed.

Assume that $\dot{\lambda}$ and $\dot{\eta}$ represent the actual deformation rate and the actual air gap change rate in a heat transfer-based width adjustment process, then.

$$\dot{\eta} = \frac{1}{2}L\omega = \frac{1}{2}L\frac{\alpha}{U_c} \tag{6a}$$

$$\dot{\lambda} = \frac{1}{2}L\omega = \frac{1}{2}L\frac{\alpha}{U_c} \tag{6b}$$

The above formulas show that the casting billet deformation rate and the air gap change rate in a heat transfer-based width adjustment process for a continuous casting mold have no direct relation with the speed used in heat transfer-based width adjustment of a continuous casting mold, but only depend on the angular velocity $\omega$ used in heat transfer-based width adjustment of a continuous casting mold. In addition, as the angular velocity is the ratio of a used in heat transfer-based width adjustment to the casting speed $U_C$, when the casting speed is constant, the shell deformation rate and the air gap change rate only depend on the horizontal acceleration velocity $\alpha$ used in heat transfer-based width adjustment; in a heat transfer-based width adjustment process for a continuous casting mold, if the casting speed UC and the horizontal acceleration velocity $\alpha$ used in width adjustment are constant, then $\omega$ is constant, and the shell deformation rate and the air gap change rate keep unchanged at this time.

To study model parameters used in heat transfer-based width adjustment of a continuous casting mold, the first consideration is to avoid surface quality defects (such as surface cracks, narrow mold wall bulging, and collapse) in a casting billet and ensure production safety (such as avoiding steel leakage accidents caused by heat transfer-based width adjustment), which can be solved from two aspects: constraint of a maximum air gap (sufficient and uniform cooling is ensured, thereby preventing narrow mold wall bulging) and constraint of shell strength (a strain of the shell is controlled to be less than a critical strain, thereby preventing collapse of the casting billet). Therefore, this embodiment takes these two aspects as the principles for setting the parameters of a width adjustment model, and formula derivation and quantitative studies are carried out on the horizontal acceleration velocity $\alpha$ and the angular velocity $\omega$ used in heat transfer-based width adjustment of a continuous casting mold.

Constraint of a Maximum Air Gap: The basic function of a continuous casting mold is to remove heat from molten steel, and form and maintain the shape of a shell; the existence of an air gap will affect the heat transfer efficiency of the continuous casting mold and the solidification rate of the shell, and weaken the basic function of the continuous casting mold. The most significant thermal resistance in the heat transfer of the continuous casting mold is from the air gap between the shell and the continuous casting mold, the thermal resistance of the air gap accounts for 71%-90% of the total thermal resistance, and even a small change of the air gap will have a great influence on the whole temperature field for the solidification of the casting billet. Therefore, the maximum air gap between a narrow mold wall and a casting billet of a continuous casting mold must be controlled by parameter settings of a heat transfer-based width adjustment model of a continuous casting mold to prevent the corner surface defects and longitudinal cracks of the casting billet.

In a heat transfer-based width adjustment process for a continuous casting mold, if a copper plate of a narrow mold wall rotates around the center of the narrow mold wall to achieve taper change (as shown in FIG. 1), and a maximum air gap is formed on either end of the narrow mold wall and has a distance of L/2 from the center of the narrow mold wall, then the cumulative change of the air gap within a time of ½ $L/U_c$ is the maximum air gap between the narrow mold wall and the casting billet shell in the heat transfer-based width adjustment process for a continuous casting mold, which is expressed as follows:

$$\eta_{max} = \int_0^{\frac{1}{2}L/U_c} \dot{\eta}\, dt = \frac{1}{4}L^2\omega/U_c \tag{7}$$

In combination with formula (6a) and formula (7), the control formula of the horizontal acceleration velocity subject to constraints of a maximum air gap between a narrow mold wall and a casting billet of a continuous casting mold $\alpha_\eta$ is as follows:

$$\alpha_\eta \le \frac{4\eta_{max}U_c^2}{L^2} \tag{2}$$

Constraint of Shell Strength: The prerequisite of production safety in a heat transfer-based width adjustment process for a continuous casting mold is to avoid steel leakage accidents, and one of the causes of steel leakage is cracks in a shell. The following three hypotheses can be used as criteria for judging whether cracks will occur in a shell: ① critical strain hypothesis; ② critical stress hypothesis; ③ critical time hypothesis. A comprehensive strain of a casting billet less than $\varepsilon$ safety strain (0.3%-0.7%) is taken as the basis of roll-layout design. Therefore, the strain rate of the casting billet shell shall be guaranteed to be less than the critical strain rate in a heat transfer-based width adjustment process for a continuous casting mold. so as to avoid the risk of surface cracks or even steel leakage of the casting billet due to overpressure. The critical strain of the casting billet shell is related to steel grade, shell thickness and surface temperature.

Assume that the width of the whole casting billet is 2W, the adjusted width of each narrow mold wall is half of the width of the casting billet, i.e. W, and the strain of the casting billet is $\varepsilon$ which is defined as a deformation amount divided by $\lambda$, then formula (6b) is expressed by a strain rate $\dot{\varepsilon}(\dot{\varepsilon}=d\varepsilon/dt)$ as follows:

$$\dot{\varepsilon}=\dot{\lambda}/W\tfrac{1}{2}L\omega/W \tag{8}$$

In order to avoid casting defects, the strain rate of the casting billet must be less than the critical strain rate $\dot{\varepsilon}_0$ determined by shell strength, then:

$$\dot{\varepsilon}_{max}\le\dot{\varepsilon}_U \tag{9}$$

Therefore, the control formula of the horizontal acceleration velocity subject to the constraint of shell strength $\alpha_\varepsilon$ is as follows:

$$\alpha_\varepsilon \le \frac{2W\dot{\varepsilon}_o U_c}{L} \tag{3}$$

Boundary Conditions for Model Parameter Setting: A boundary condition of a model parameter (horizontal acceleration velocity $\alpha$) used in heat transfer-based width adjustment of a continuous casting mold is set to a minimum value subject to constraints of a maximum air gap and shell strength, as shown in formula (1).

$$\alpha\le\min(\alpha_\eta,\alpha_o) \tag{1}$$

Figure 2:
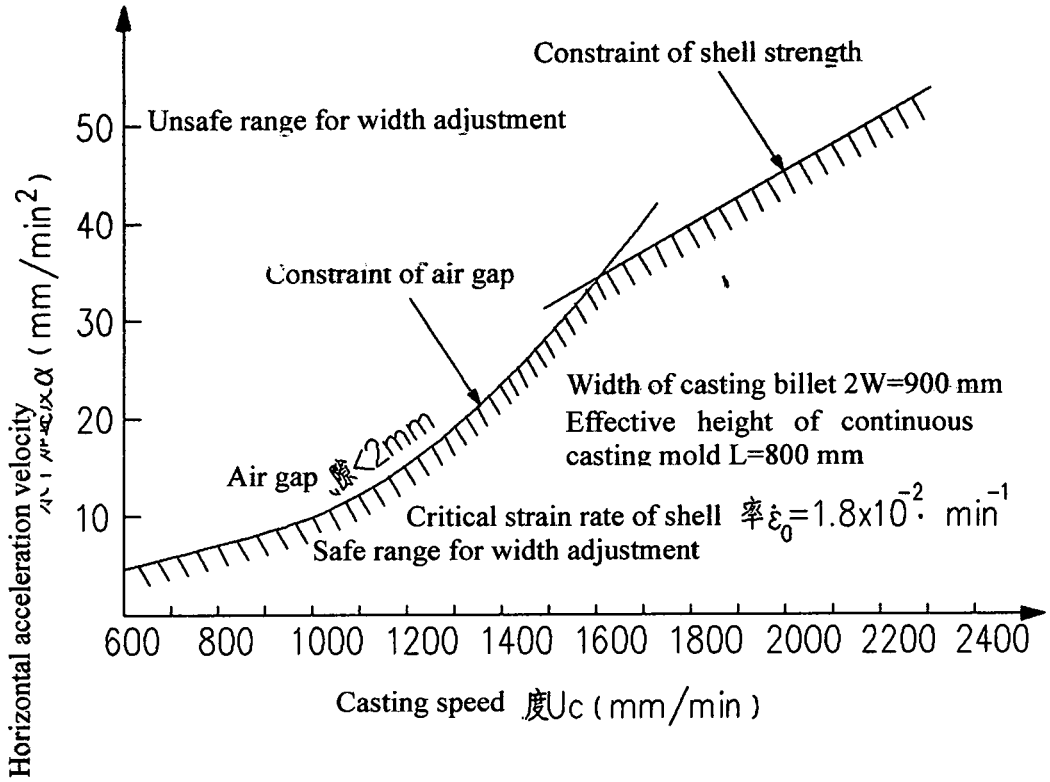
FIG. 2 is a schematic diagram of boundary conditions for parameter settings of a heat transfer-based width adjustment model of a continuous casting mold.

FIG. 2 is a schematic diagram of boundary conditions for parameter settings of a heat transfer-based width adjustment model of a continuous casting mold; when the casting speed $U_C$ is in a relatively low range, the horizontal acceleration velocity $\alpha_s$ is mainly subject to the constraint of air gap and is in direct proportion to the square of the casting speed $U_C$. When the casting speed $U_C$ reaches a relatively high range, the horizontal acceleration velocity $\alpha_s$ is mainly subject to the constraint of shell strength and is in direct proportion to the casting speed $U_C$, as shown in formula (4), the angular velocity $\omega_s$ is the ratio of the horizontal acceleration velocity $\alpha_s$ to the casting speed $U_C$, and the boundary condition of the angular velocity $\omega_s$ can be easily determined after the boundary condition of the horizontal acceleration velocity is determined.

Embodiment 1

According to production technological experience, the critical strain rate is $\dot{\varepsilon}_0=1.8\times10^{-2}\cdot\text{min}^{-1}$ (when the temperature of a casting billet for medium carbon steel is 1350° C.), the maximum air gap is $\eta_{max}$=2 mm, the minimum width of the casting billet is 2W=900 mm, and the effective height of a continuous casting mold is L=800 mm. According to the above formulas, the set values of model parameters can be obtained, as shown in Table 1.

TABLE 1

| Model Parameter Setting | | | | | | |
|---|---|---|---|---|---|---|
| | Casting speed | | | | | |
| $U_C$ Model parameters | 800 (mm/min) | 1000 (mm/min) | 1200 (mm/min) | 1400 (mm/min) | 1600 (mm/min) | 1800 (mm/min) |
| Acceleration velocity $\alpha_\eta$ (mm/min$^2$, constraint of air gap) | 8 | 12.5 | 18 | 24.5 | 32 | 40.5 |
| Angular velocity $\omega_\eta$ (rad/min, constraint of air gap) | 0.01 | 0.0125 | 0.015 | 0.0175 | 0.02 | 0.0225 |
| Acceleration velocity $\alpha_\varepsilon$ (mm/min$^2$, constraint of shell strength) | 16.2 | 20.25 | 24.3 | 28.35 | 32.4 | 36.45 |
| Angular velocity $\omega_\varepsilon$ (rad/min, constraint of shell strength) | 0.02025 | 0.02025 | 0.02025 | 0.02025 | 0.02025 | 0.02025 |
| Acceleration velocity $\alpha_s$ (mm/min$^2$, model setting) | 8 | 12.5 | 18 | 24.5 | 32 | 36.45 |
| Angular velocity $\omega_s$ (rad/min, model setting) | 0.01 | 0.0125 | 0.015 | 0.0175 | 0.02 | 0.02025 |
| Horizontal moving speed $V_h$ (mm/min) | 8 · t | 12.5 · t | 18 · t | 24.5 · t | 32 · t | 36.45 · t |

Embodiment 2

Assume that the casting speed is $U_C$=1200 mm/min during width adjustment, and the effective height of a continuous casting mold is L=800 mm, then the technological requirements are that: the critical strain rate is $\dot{\varepsilon}_0=1.8\times10^{-2}\cdot min^{-1}$, the maximum air gap is $\eta_{max}$=2 mm, and the minimum width of a casting billet is 2W=900 mm.

1) Safe Range for Width Adjustment: If the actual horizontal acceleration velocity used in width adjustment is $\alpha$=15 mm/min$^2$ (less than the boundary condition $\alpha_s$=18 mm/min$^2$), then the angular velocity is $\omega$=0.0125 rad/min; if the air gap in a width adjustment process is $\eta$=1.67 mm, and the strain rate of a casting billet shell is $\dot{\varepsilon}=1.1\times10^{-2}\cdot min^{-1}$, then the constraint of a maximum air gap ($\eta\leqslant\eta_{max}$) and the constraint of casting billet shell strength ($\dot{\varepsilon}\leq\dot{\varepsilon}_0$) according technological requirements are met, which can ensure a relatively close contact between a narrow mold wall and a casting billet shell of a continuous casting mold, and a sufficient and uniform cooling, prevent narrow mold wall bulging, and avoid cracks of the casting billet shell due to overpressure.

2) Unsafe Range for Width Adjustment: If the actual horizontal acceleration velocity used in width adjustment is $\alpha$=24 mm/min$^2$ (greater than the boundary condition $\alpha_s$=18 mm/min$^2$), then the angular velocity is $\omega$=0.02 rad/min; if the air gap in a width adjustment process is $\eta$=2.67 mm, and the strain rate of a casting billet shell is $\dot{\varepsilon}=1.78\times10^{-2}\cdot min^{-1}$, then the constraint of casting billet shell strength ($\dot{\varepsilon}\leq\dot{\varepsilon}_0$) according technological requirements is met, but the constraint of a maximum air gap is not met ($\eta>\eta_{max}$), the air gap between a narrow mold wall and a casting billet shell of a continuous casting mold is relatively large, and edge and corner cracks of the casting billet shell and narrow mold wall bulging are caused due to insufficient cooling.

Embodiment 3

Assume that the casting speed is $U_C$=1800 mm/min during width adjustment, and the effective height of a continuous casting mold is L=800 mm, then the technological requirements are that: the critical strain rate is $\dot{\varepsilon}_0=1.8\times10^{-2}\cdot min^{-1}$, the maximum air gap is $\eta_{max}$=2 mm, and the minimum width of a casting billet is 2W=900 mm.

1) Safe Range for Width Adjustment: If the actual horizontal acceleration velocity used in width adjustment is $\alpha$=32 mm/min2 (less than the boundary condition $\alpha_s$=36.45 mm/min$^2$), then the angular velocity is $\omega$=0.018 rad/min; if the air gap in a width adjustment process is $\eta$=1.58 mm, and the strain rate of a casting billet shell is $\dot{\varepsilon}=1.58\times10^{-2}\cdot min^{-1}$. then the constraint of a maximum air gap ($\eta\leqslant\eta_{max}$) and the constraint of casting billet shell strength ($\dot{\varepsilon}\leq\dot{\varepsilon}_0$) according technological requirements are met, which can ensure a relatively close contact between a narrow mold wall and a casting billet shell of a continuous casting mold, and a sufficient and uniform cooling, prevent narrow mold wall bulging, and avoid cracks of the casting billet shell due to overpressure.

2) Unsafe Range for Width Adjustment: If the actual horizontal acceleration velocity used in width adjustment is $\alpha$=40 mm/min$^2$ (greater than the boundary condition $\alpha_s$=18 mm/min$^2$), then the taper change velocity is $\omega$=0.022 rad/min; if the air gap in a width adjustment process is $\eta$=1.98 mm, and the strain rate of a casting billet shell is $\dot{\varepsilon}=1.98\times10^{-2}\cdot min^{-1}$, then the constraint of a maximum air gap ($\eta\leqslant\eta_{max}$) according technological requirements is met, but the constraint of casting billet shell strength is not met ($\dot{\varepsilon}>\dot{\varepsilon}_0$), and concave and convex defects occurs on the surface of the casting billet.

As stated above, the present invention has the following beneficial effects:

1. An air gap between a copper plate of a narrow mold wall and a casting billet in a whole width adjustment process is minimum, and the supporting of the narrow mold wall to the casting billet shell is stable and uniform, therefore the present invention can adapt to all steel grades, avoid the risk of steel leakage, and ensure production safety.

2. A relatively high horizontal acceleration velocity is used as far as possible in width adjustment while ensuring the production safety, therefore the present invention can increase the width adjustment speed, greatly shorten the time of width adjustment, and reduce the cutting waste caused by width adjustment.

3. Width adjustment can be performed within a full casting speed range at an actual production speed without having to increase or decrease the casting speed, therefore the present invention can ensure constancy of production technological parameters so as to ensure stability of casting billet quality.

The above embodiments are only used for exemplarily describing the principles and effects of the present invention rather than limiting the present invention. Any of those skilled in the art can modify or change the above embodiments without deviating from spirits and categories of the present invention. Therefore, all equivalent modifications or changes completed by ordinary intellectuals in the technical field without departing from spirits and technical thoughts revealed in the present invention shall still be covered by claims of the present invention.

The invention claimed is:

1. A heat transfer-based width adjustment method for a continuous casting mold, characterized in that a boundary condition of a horizontal acceleration velocity $\alpha$ used in heat transfer-based width adjustment of a continuous casting mold is set to a minimum value subject to constraints of a maximum air gap and shell strength, as shown in formula (1):

$$\alpha \leq \min(\alpha_\eta, \alpha_\varepsilon) \tag{1}$$

in formula (1), $\alpha_\eta$ is a maximum horizontal acceleration velocity subject to constraints of a maximum allowable air gap between a narrow mold wall and a casting billet shell of a continuous casting mold, and the unit is mm/min$^2$; $\alpha_\varepsilon$ is a maximum horizontal acceleration velocity subject to constraint of shell strength, and the unit is mm/min$^2$, and characterized in that the maximum horizontal acceleration velocity subject to constraints of a maximum allowable air gap between a narrow mold wall and a casting billet shell of a continuous casting mold $\alpha_\eta$ is shown in formula (2):

$$\alpha_\eta \leq \frac{4\eta_{max} U_c^2}{L^2} \tag{2}$$

in formula (2), $\eta_{max}$ is a maximum allowable air gap between a narrow mold wall and a casting billet shell of a continuous casting mold, and the unit is mm; Uc is a casting speed, and the unit is mm/min; L is an effective height of a continuous casting mold, and the unit is mm, and characterized in that the maximum horizontal acceleration velocity subject to constraint of shell strength ac is shown in formula (3):

$$\alpha_\varepsilon \leq \frac{2W\dot{\varepsilon}_o U_c}{L} \tag{3}$$

where, W is half of a width of a casting billet, and the unit is mm; $\dot{\varepsilon}_0$ is a critical strain rate of the casting billet, and the unit is min$^{-1}$; Uc is a casting speed, and the unit is mm/min; L is an effective height of a continuous casting mold, and the unit is mm.

2. The method according to claim 1, characterized in that $0.8 \cdot \min(\alpha_\eta, \alpha_\varepsilon) \leq \alpha \leq \min(\alpha_\eta, \alpha_\varepsilon)$.

3. The method according to claim 1, characterized in that 1 mm$\leq \eta_{max} \leq$4 mm.

4. The method according to claim 1, characterized in that 600 mm/min$\leq U_C \leq$2400 mm/min.

5. The method according to claim 1, characterized in that 800 mm$\leq$L$\leq$900 mm.

6. The method according to claim 1, characterized in that $1.2\times10^{-2}\cdot\text{min}^{-1} \leq \dot{\varepsilon}_0 \leq 3.3\times10^{-2}\cdot\text{min}^{-1}$.

7. The method according to claim 1, characterized in that 450 mm$\leq$W$\leq$1300 mm.

8. The method according to claim 1, characterized in that movement of a narrow mold wall of a continuous casting mold is a combination of horizontal movement and taper change movement, and angular velocity $\omega$ satisfies the following formula:

$$\omega = \alpha / U_c \tag{4}$$

in formula (4), the unit of the angular velocity $\omega$ is rad/min, and the unit of the casting speed $U_C$ is mm/min.

9. The method according to claim 1, characterized in that 800 mm$\leq$L$\leq$900 mm.

* * * * *